US010805991B2

(12) United States Patent
Li et al.

(10) Patent No.: US 10,805,991 B2
(45) Date of Patent: Oct. 13, 2020

(54) MICROWAVE OVEN

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Wei Li, Foshan (CN); Mingbo An, Foshan (CN); Qihong Ling, Foshan (CN)

( * ) Notice: Subject to any disclaimer, the term of this patent is extended or adjusted under 35 U.S.C. 154(b) by 263 days.

(21) Appl. No.: 15/997,682

(22) Filed: Jun. 4, 2018

(65) Prior Publication Data

US 2018/0288834 A1 Oct. 4, 2018

Related U.S. Application Data

(63) Continuation of application No. PCT/CN2016/087164, filed on Jun. 24, 2016.

(30) Foreign Application Priority Data

Dec. 8, 2015 (CN) ..... 2015 1 0898286
Dec. 8, 2015 (CN) ..... 2015 2 1013277 U

(51) Int. Cl.
*H05B 6/64* (2006.01)
*F24C 7/02* (2006.01)

(52) U.S. Cl.
CPC ..... *H05B 6/642* (2013.01); *H05B 6/6426* (2013.01)

(58) Field of Classification Search
CPC ..... H05B 6/642; H05B 6/6426
USPC ..... 219/757, 721, 761, 715, 750; 428/328, 428/450, 471; 363/126; 331/185; 333/258
See application file for complete search history.

(56) References Cited

U.S. PATENT DOCUMENTS 3,129,312 A * 4/1964 Ojelid ..... H05B 6/666 219/757

FOREIGN PATENT DOCUMENTS

CN 1520234 A 8/2004
CN 201251216 Y 3/2009
(Continued)

OTHER PUBLICATIONS

The Office Action dated May 21, 2019 in the corresponding JP application No. 2018-528291.
(Continued)

*Primary Examiner* — Quang T Van
(74) *Attorney, Agent, or Firm* — Kilpatrick Townsend & Stockton, LLP

(57) ABSTRACT

A microwave oven has a cooking cavity and an electrical chamber, with a magnetron, a frequency converter assembly and a cooling fan arranged in the electrical chamber. The frequency converter assembly has a mounting support mounted on a bottom plate of the microwave oven, a mounting base obliquely mounted on the mounting support, a frequency converter circuit board mounted on the mounting base and obliquely arranged relative to the bottom plate of the microwave oven, and an air guide cover covering over the frequency converter circuit board for guiding cool air blown by the cooling fan to the frequency converter circuit board. The microwave oven can not only solve the problem that the mounting space for frequency converter circuit boards is not sufficient, but also effectively control the temperature rise of the frequency converter circuit boards.

20 Claims, 3 Drawing Sheets

(56) References Cited

FOREIGN PATENT DOCUMENTS

| | | | |
|---|---|---|---|
| CN | 201555270 | U | 8/2010 |
| CN | 202361431 | U | 8/2012 |
| CN | 203457401 | U | 2/2014 |
| CN | 204240427 | U | 4/2015 |
| CN | 104633726 | A | 5/2015 |
| CN | 105387492 | A | 3/2016 |
| CN | 205191665 | U | 4/2016 |
| JP | 54060207 | U | 5/1979 |
| JP | 2306027 | A | 12/1990 |
| JP | H11325473 | A | 11/1999 |
| JP | 2008052959 | A | 3/2003 |
| JP | 2003336850 | A | 11/2003 |

OTHER PUBLICATIONS

International Search Report dated Sep. 26, 2016 in the corresponding CN application (application No. PCT/CN2016/087164).

* cited by examiner

MICROWAVE OVEN

CROSS-REFERENCE TO RELATED APPLICATION

The present application is a continuation of International Application PCT/CN2016/087164, filed Jun. 24, 2016, which claims the priority of Chinese Application No. 201510898286.4, filed in Chinese Patent Office on Dec. 8, 2015, and entitled "MICROWAVE OVEN"; it also claims the priority of Chinese Application No. 201521013277.4, filed in Chinese Patent Office on Dec. 8, 2015, and entitled "MICROWAVE OVEN", the entire contents of which are herein incorporated by reference.

FIELD

The present disclosure relates to the field of kitchen appliances, and more particularly, relates to a microwave oven.

BACKGROUND

The existing microwave oven used at a commercial place such as a restaurant, a convenience store or the like that requires rapid heating generally adopts two or more frequency converters, and the frequency converters are mounted at an original high-voltage transformer so as not to change the original structure as much as possible. However, the mounting space for the microwave oven is small, the frequency converters are large, and the mounting space required for vertically placing the frequency converters is large, so that the mounting space for the frequency converters is insufficient, and miniaturization of the microwave oven is unfavorable; the horizontal placement of the frequency converters is not conducive to heat dissipation of the frequency converters, and the performance of the frequency converters will decline if the temperature rise of the frequency converters is too high.

SUMMARY

The present disclosure aims to solve at least one of the technical problems in the prior art.

Thus, embodiments of the present disclosure are to provide a microwave oven, which not only solves the problem of insufficient space for mounting frequency converter circuit boards, but also effectively controls the temperature rise of the frequency converter circuit boards.

An embodiment of the present disclosure provides a microwave oven. The microwave oven is provided with a cooking cavity and an electrical chamber located behind the cooking cavity; a magnetron, a frequency converter assembly and a cooling fan are arranged in the electrical chamber; the frequency converter assembly includes a mounting support, a mounting base, a frequency converter circuit board and an air guide cover, and the mounting support is mounted on a bottom plate of the microwave oven; the mounting base is obliquely mounted on the mounting support; the frequency converter circuit board is mounted on the mounting base and obliquely arranged relative to the bottom plate of the microwave oven; and the air guide cover covers over the frequency converter circuit board and is used for guiding cool air blown by the cooling fan to the frequency converter circuit board.

According to the microwave oven provided in the above embodiment of the present disclosure, the frequency converter circuit board is mounted on the oblique mounting base, that is, the frequency converter circuit board is obliquely mounted on the bottom plate of the microwave oven through the mounting support and the mounting base, so compared with the situation that the frequency converter circuit board is placed vertically, the height of the frequency converter circuit board is effectively reduced, the problem that the mounting space for the frequency converter circuit board is limited due to the small mounting space for the microwave oven is solved, and the structure of the microwave oven is more compact; in addition, the height reduction of the frequency converter circuit board facilitates miniaturization of the microwave oven; compared with the situation that the frequency converter circuit board is placed horizontally, the cooling fan above the frequency converter circuit board can effectively cool the frequency converter circuit board through the air guide cover above the frequency converter circuit board, thereby avoiding the problem that the performance of the frequency converter circuit board declines due to too high temperature rise when the frequency converter circuit board is placed horizontally, and ensuring the working reliability of the microwave oven. In other words, according to the microwave oven provided by the present disclosure, the frequency converter circuit board is mounted obliquely, so that the problem that the mounting space for the frequency converter circuit board is not sufficient is solved, the temperature rise of the frequency converter circuit board is effectively controlled, then the working reliability of the microwave oven is guaranteed, and miniaturization of the microwave oven is facilitated; in addition, according to the technical solution that oblique mounting of the frequency converter circuit board is realized by adopting the mounting support and the mounting base, the structure is simple, and a mold is easy to manufacture and repair.

In addition, the microwave oven provided by the above embodiment of the present disclosure also has the following additional technical features:

According to an embodiment of the present disclosure, an air guide inlet opposite to an air outlet of the cooling fan is formed at the front end of the air guide cover, and an air guide outlet communicating with the air guide inlet is formed at the tail end of the air guide cover.

In the above embodiment, the air guide inlet of the air guide cover is opposite to the air outlet of the cooling fan, and the cool air blown by the cooling fan is directly blown to the frequency converter circuit board via the air guide inlet of the air guide cover to effectively cool the frequency converter circuit board, thereby ensuring the cooling effect on the frequency converter circuit board. The hot air after heat exchange of the frequency converter circuit board is blown through the air guide outlet of the air guide cover.

According to an embodiment of the present disclosure, an air inlet passage is formed between an outer cover of the microwave oven and the side wall of the cooking cavity, the bottom plate of the microwave oven is provided with air inlets communicating with the air inlet passage, and an exhaust opening of the cooling fan faces the air inlet passage.

In the above embodiment, the exhaust opening of the cooling fan faces the air inlet passage, so that external low-temperature air is sucked into the air inlet passage formed between the outer cover and the side wall of the cooking cavity through the air inlets, flows through the cooling fan and then is blown from the air outlet of the cooling fan to the frequency converter circuit board. Since the air guide inlet of the air guide cover is directly opposite to the air outlet of the cooling fan, the low-temperature air enters the air guide cover to cool the frequency converter circuit board below the air guide cover, and the hot air after heat exchange of the frequency converter circuit board is blown out via the air guide outlet of the air guide cover, to realize effective cooling on the frequency converter circuit board.

According to an embodiment of the present disclosure, the air guide cover includes two opposite side plates and a cover plate connected with the two side plates, the air guide inlet is formed at the front end of the cover plate, and the plate surface of the cover plate is gradually inclined upwards from back to front.

In the above embodiment, the plate surface of the cover plate of the air guide cover is gradually inclined upwards from back to front, that is, the air guide inlet of the cover plate gradually expands outwards to enlarge the area of the air guide inlet, thereby increasing the amount of air entering the air guide cover from the air guide inlet. Moreover, the plate surface of the cover plate is gradually inclined downwards along the flow direction of air in the air guide cover, which is beneficial to improving the flow direction of the air, so that the air is directly blown to the frequency converter circuit board below the air guide cover to improve the heat dissipation effect on the frequency converter circuit board.

According to an embodiment of the present disclosure, a rear plate of the microwave oven is provided with an exhaust outlet communicating with the air guide outlet, so that the hot air after heat exchange of the frequency converter circuit board is blown out of the air guide cover through the air guide outlet and then exhausted out of the microwave oven through the exhaust outlet of the rear plate of the microwave oven.

According to an embodiment of the present disclosure, the mounting support is provided with guide bevels gradually inclined downwards from front to back, and the mounting base is supported on the guide bevels.

According to an embodiment of the present disclosure, barbs extending upwards are formed at the tail end of the guide bevels, the tail end of the mounting base abuts against the barbs, and a lug for limiting the mounting base to move left and right is arranged at the tail end of the mounting base.

In the above embodiment, the mounting base is supported on the guide bevels of the mounting support, and the mounting base is limited through the barbs of the guide bevels and the lug of the mounting base, so that the mounting firmness of the mounting base on the mounting support is ensured; and according to the technical solution that oblique mounting of the frequency converter circuit board is realized by adopting the mounting support and the mounting base, the structure is simple, and a mold is easy to manufacture and repair.

According to an embodiment of the present disclosure, a mounting groove with the upper end opened is formed in the mounting base, the frequency converter circuit board is located in the mounting groove, and the air guide cover is mounted above the mounting base and clamped with the mounting base.

In the above embodiment, the frequency converter circuit board is mounted in the mounting groove formed in the mounting base to ensure the mounting firmness of the frequency converter circuit board; and the air guide cover is mounted above the mounting base through a clamping fixing manner, so that the structure is simple and is fixed firmly.

According to one embodiment of the present disclosure, a plurality of magnetrons, a plurality of frequency converter assemblies and a plurality of cooling fans for cooling the plurality of magnetrons and the plurality of frequency converter assemblies are arranged in the electrical chamber.

According to an embodiment of the present disclosure, each of the upper part and the lower part of the electrical chamber is provided with one magnetron, each of two sides of the magnetron at the upper part is provided with one cooling fan, and each of two sides of the magnetron at the lower part is provided with one frequency converter assembly.

BRIEF DESCRIPTION OF THE DRAWINGS

The present disclosure will become apparent and be easily understood from the following description of embodiments in conjunction with the accompanying drawings, in which.

Figure 1:
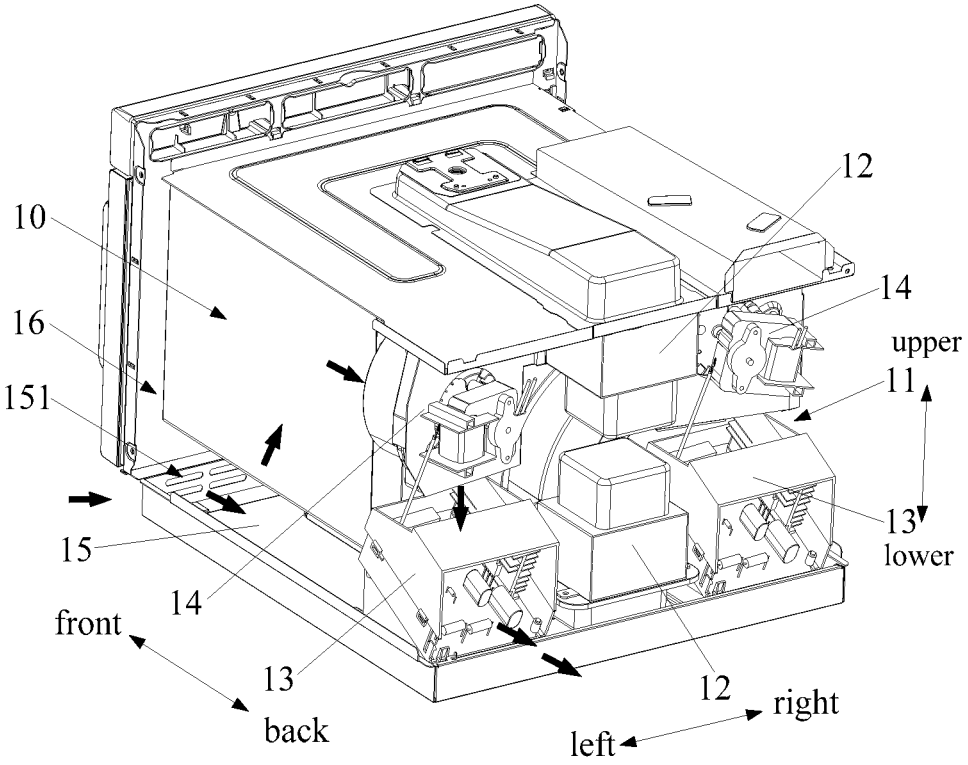
FIG. 1 is a schematic diagram of a partial three-dimensional structure of a microwave oven according to an embodiment of the present disclosure.
Figure 2:
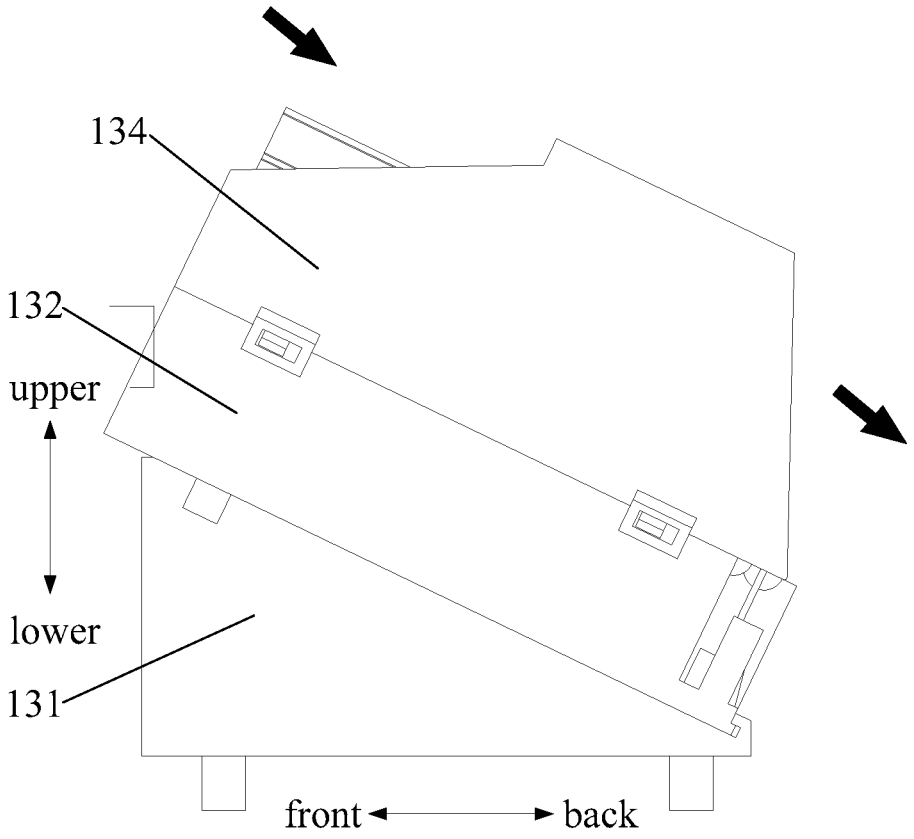
FIG. 2 is a schematic diagram of a main view structure of a frequency converter assembly in the microwave oven shown in FIG. 1.
Figure 3:
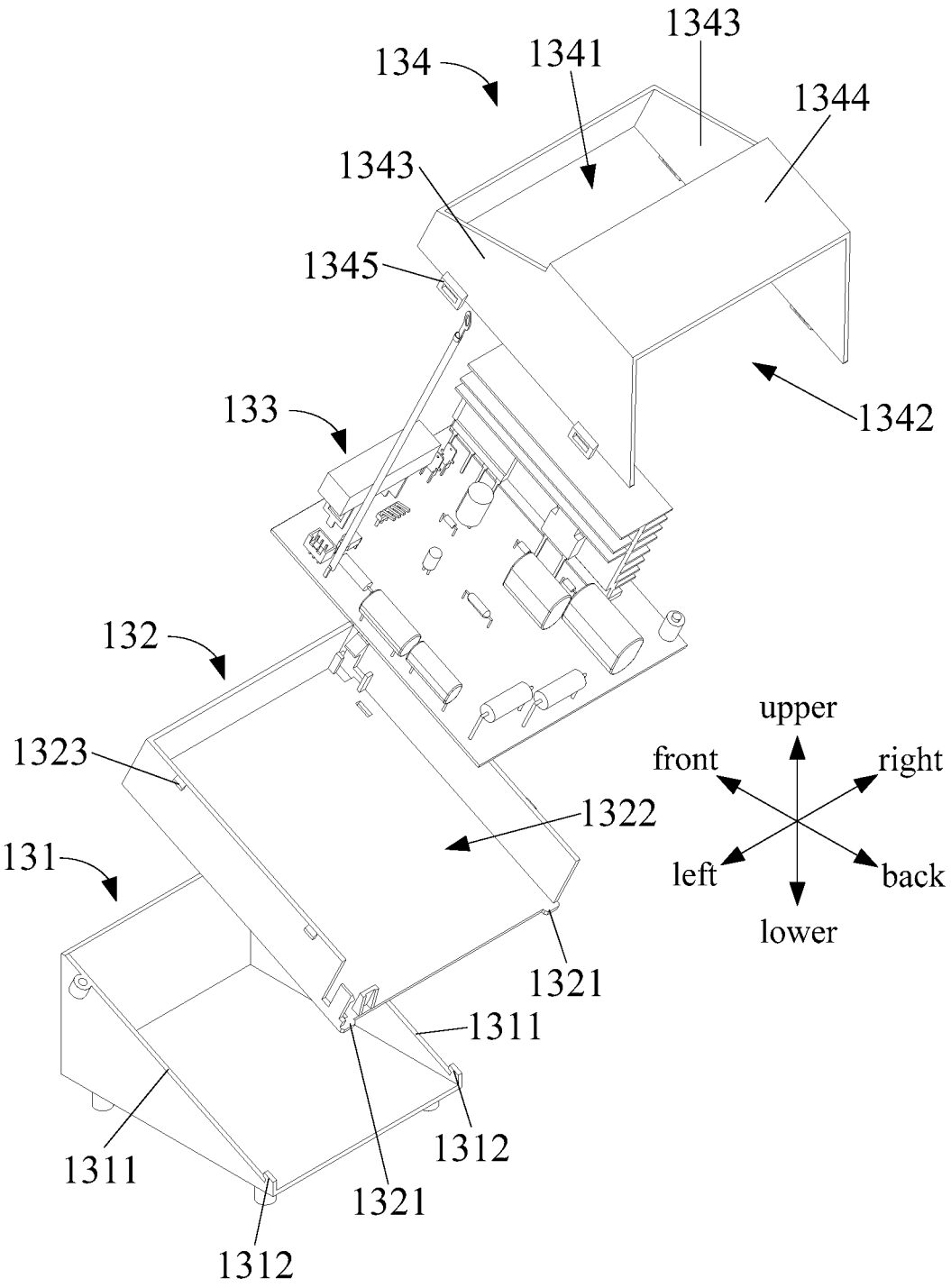
FIG. 3 is a schematic diagram of an exploded structure of the frequency converter assemblies in the microwave oven shown in FIG. 1.

The correspondence between the reference signs and the component names in FIG. 1 to FIG. 3 is:

10: cooking cavity, 11: electrical chamber, 12: magnetron, 13: frequency converter assembly, 131: mounting support, 1311: guide bevel, 1312: barb, 132: mounting base, 1321: lug, 1322: mounting groove, 1323: buckle, 133: frequency converter circuit board, 134: air guide cover, 1341: air guide inlet, 1342: air guide outlet, 1343: side plate, 1344: cover plate, 1345: clamping hole, 14: cooling fan, 15: bottom plate, 151: air inlet, 16: air inlet passage, bold arrows in FIG. 1 and FIG. 2 indicating the flow direction of air.

DETAILED DESCRIPTION

In the following description, numerous specific details are set forth in order to fully understand the present disclosure. However, the present disclosure can also be implemented in other ways than those described herein. Therefore, the scope of the present disclosure is not limited to the specific embodiments disclosed below.

A microwave oven according to some embodiments of the present disclosure will be described below with reference to the accompanying drawings.

As shown in FIG. 1, a microwave oven according to some embodiments of the present disclosure is provided with a cooking cavity 10 and an electrical chamber 11 behind the cooking cavity 10. Magnetrons 12, frequency converter assemblies 13 and cooling fans 14 are arranged in the electrical chamber 11.

Each frequency converter assembly 13 includes a mounting support 131, a mounting base 132, a frequency converter circuit board 133 and an air guide cover 134.

Specifically, the mounting support 131 is mounted on a bottom plate 15 of the microwave oven; the mounting base 132 is obliquely mounted on the mounting support 131; the frequency converter circuit board 133 is mounted on the mounting base 132 and is inclined relative to the bottom plate 15 of the microwave oven; and the air guide cover 134 covers over the frequency converter circuit board 133, and is used for guiding cool air blown by the cooling fan 14 to the frequency converter circuit board 133.

According to the microwave oven provided in the above embodiment of the present disclosure, the frequency converter circuit boards 133 are mounted on the oblique mounting bases 132, that is, the frequency converter circuit boards 133 are obliquely mounted on the bottom plate 15 of the microwave oven through the mounting supports 131 and the mounting bases 132, so compared with the situation that the frequency converter circuit boards 133 are placed vertically, the heights of the frequency converter circuit boards 133 are effectively reduced, the problem that the mounting space for the frequency converter circuit boards 133 is limited and not sufficient due to the small mounting space for the microwave oven is solved, and the structure of the microwave oven is more compact; in addition, the height reduction of the frequency converter circuit boards 133 facilitates miniaturization of the microwave oven; compared with the situation that the frequency converter circuit boards 133 are placed horizontally, the cooling fans 14 above the frequency converter circuit boards 133 can effectively cool the frequency converter circuit boards 133 through the air guide covers above the frequency converter circuit boards 133, thereby avoiding the problem that the performance of the frequency converter circuit boards 133 declines due to too high temperature rise when the frequency converter circuit boards 133 are placed horizontally, and ensuring the working reliability of the microwave oven. In other words, according to the microwave oven provided by the present disclosure, the frequency converter circuit boards are mounted obliquely, so that the problem that the mounting space for the frequency converter circuit boards 133 is not sufficient is solved, the temperature rise of the frequency converter circuit boards 133 is effectively controlled, then the working reliability of the microwave oven is guaranteed, and miniaturization of the microwave oven is facilitated; in addition, according to the technical solution that oblique mounting of the frequency converter circuit boards 133 is realized by adopting the mounting supports 131 and the mounting bases 132, the structure is simple, and a mold is easy to manufacture and repair.

In some embodiments of the present disclosure, as shown in FIG. 1 and FIG. 3, an air guide inlet 1341 opposite to an air outlet of the cooling fan 14 is formed at the front end of the air guide cover 134, and an air guide outlet 1342 communicating with the air guide inlet 1341 is formed at the tail end of the air guide cover 134.

In the above embodiment, the air guide inlet 1341 of the air guide cover 134 is opposite to the air outlet of the cooling fan 14, and the cool air blown by the cooling fan 14 is directly blown to the frequency converter circuit board 133 via the air guide inlet 1341 of the air guide cover 134 to effectively cool the frequency converter circuit board 133, thereby ensuring the cooling effect on the frequency converter circuit board 133. The hot air after heat exchange of the frequency converter circuit board 133 is blown through the air guide outlet 1342 of the air guide cover 134. Bold arrows in FIG. 2 show the flow direction of air.

Further, as shown in FIG. 1, an air inlet passage 16 is formed between an outer cover (not shown in the figure) of the microwave oven and the side wall of the cooking cavity 10, the bottom plate 15 of the microwave oven is provided with air inlets 151 communicating with the air inlet passage 16, and exhaust openings of the cooling fans 14 face the air inlet passage 16.

In the above embodiment, the exhaust openings of the cooling fans 14 face the air inlet passage 16, so that external low-temperature air is sucked into the air inlet passage 16 formed between the outer cover and the side wall of the cooking cavity 10 through the air inlets 151, flows through the cooling fans 14 and then is blown from the air outlets of the cooling fans 14 to the frequency converter circuit boards 133. Since the air guide inlets 1341 of the air guide covers 134 are directly opposite to the air outlets of the cooling fans 14, the low-temperature air enters the air guide covers 134 to cool the frequency converter circuit boards 133 below the air guide covers 134, and the hot air after heat exchange of the frequency converter circuit boards 133 is blown out via the air guide outlets 1342 of the air guide covers 134, as shown in bold arrows (indicating the flow direction of air) in FIG. 1, to realize effective cooling on the frequency converter circuit boards 133.

In a specific embodiment of the present disclosure, as shown in FIG. 2 and FIG. 3, the air guide cover 134 includes two opposite side plates 1343 and a cover plate 1344 connected with the two side plates 1343, the air guide inlet 1341 is formed at the front end of the cover plate 1344, and the plate surface of the cover plate 1344 is gradually inclined upwards from back to front.

In the above embodiment, the plate surface of the cover plate 1344 of the air guide cover 134 is gradually inclined upwards from back to front, that is, the air guide inlet 1341 of the cover plate 1344 gradually expands outwards to enlarge the area of the air guide inlet 1341, thereby increasing the amount of air entering the air guide cover 134 from the air guide inlet 1341. Moreover, the plate surface of the cover plate 1344 is gradually inclined downwards along the flow direction of air in the air guide cover 134, which is beneficial to improving the flow direction of the air, so that the air is directly blown onto the frequency converter circuit board 133 below the air guide cover 134 to improve the heat dissipation effect on the frequency converter circuit board 133.

Further, a rear plate (not shown in the figures) of the microwave oven is provided with an exhaust outlet communicating with the air guide outlet 1342, so that the hot air after heat exchange of the frequency converter circuit board 133 is blown out of the air guide cover 134 through the air guide outlet 1342 and then exhausted out of the microwave oven through the exhaust outlet of the rear plate of the microwave oven.

In some embodiments of the present disclosure, as shown in FIG. 2 and FIG. 3, the mounting support 131 is provided with guide bevels 1311 gradually inclined downwards from front to back, and the mounting base 132 is supported on the guide bevels 1311.

Further, as shown in FIG. 1 and FIG. 3, barbs 1312 extending upwards are formed at the tail end of the guide bevels 1311, the tail end of the mounting base 132 abuts against the barbs 1312, and a lug 1321 for limiting the mounting base 132 to move left and right is arranged at the tail end of the mounting base 132.

In the above embodiment, the mounting base 132 is supported on the guide bevels 1311 of the mounting support 131, and the mounting base 132 is limited through the barbs 1312 of the guide bevels 1311 and the lug 1321 of the mounting base 132, so that the mounting firmness of the mounting base 132 on the mounting support 131 is ensured; and according to the technical solution that oblique mounting of the frequency converter circuit board 133 is realized by adopting the mounting support 131 and the mounting base 132, the structure is simple, and a mold is easy to manufacture and repair.

In an embodiment of the present disclosure, as shown in FIG. 3, a mounting groove 1322 with the upper end opened is formed in the mounting base 132, the frequency converter circuit board 133 is located in the mounting groove 1322, and the air guide cover 134 is mounted above the mounting base 132 and clamped with the mounting base 132.

Specifically, as shown in FIG. 3, buckles 1323 are arranged on the side walls of the mounting groove 1322 of the mounting base 132, the side plates 1343 of the air guide cover 134 are provided with clamping holes 1345, and the buckles 1323 are clamped into the clamping holes 1345.

In the above embodiment, the frequency converter circuit board 133 is mounted in the mounting groove 1322 formed in the mounting base 132 to ensure the mounting firmness of the frequency converter circuit board 133; and the air guide cover 134 is mounted above the mounting base 132 through a clamping fixing manner, so that the structure is simple and the fixation is firm.

In some embodiments of the present disclosure, magnetrons 12, frequency converter assemblies 13, and cooling fans 14 for cooling the magnetrons 12 and the frequency converter assemblies 13 are arranged in the electrical chamber 11.

In a specific embodiment of the present disclosure, as shown in FIG. 1, each of the upper part and the lower part of the electrical chamber 11 is provided with one magnetron 12, each of two sides of the magnetron 12 at the upper part is provided with one cooling fan 14, and each of two sides of the magnetron 12 at the lower part is provided with one frequency converter assembly 13.

Specifically, each cooling fan 14 is provided with two or more air outlets, and one air outlet is directly opposite to the air guide inlet 1341 of the air guide cover 134, and the cool air blown from the air outlet is used for cooling the frequency converter circuit board 133; the second air outlet communicates with the magnetron 12, and the cool air blown from the air outlet is used for cooling the magnetron 12; therefore, the purpose of simultaneously cooling the magnetron 12 and the frequency converter assembly 13 can be fulfilled.

To sum up, according to the microwave oven provided by the embodiments of the present disclosure, the frequency converter circuit boards are mounted on the oblique mounting bases, i.e., the frequency converter circuit boards are obliquely mounted on the bottom plate of the microwave oven through the mounting supports and the mounting bases, and air guide cooling is effectively performed on the frequency converter circuit boards through the air guide covers above the frequency converter circuit boards, so that the problem that the mounting space for the frequency converter circuit boards is not sufficient is solved, the temperature rise of the frequency converter circuit boards is effectively controlled, then the working reliability of the microwave oven is guaranteed, and miniaturization of the microwave oven is facilitated; in addition, according to the technical solution that oblique mounting of the frequency converter circuit boards is realized by adopting the mounting supports and the mounting bases, the structure is simple, and a mold is easy to manufacture and repair.

In the description of the present disclosure, unless otherwise specified, the terms "connected", "mounted" and the like all should be generally understood, for example, the "connected" may be fixedly connected, detachably connected, integrally connected, electrically connected, directly connected or indirectly connected through a medium. In the description of this specification, it should be understood that the terms "upper", "lower", "front", "back", "left", "right" and the like indicate the orientation or position relationship based on the orientation or position relationship shown in the drawings. The terms are only for description convenience of the present disclosure and simplification of the description, but do not indicate or imply that the referred devices or units may have specific directions or be constructed and operated in specific orientations. Therefore, the terms should not be understood to limit the present disclosure.

In the description of this specification, the terms "an embodiment", "some embodiments", "a specific embodiment" and the like mean that specific features, structures, materials or characteristics described in conjunction with the embodiments or examples are included in the at least one embodiment or example of the present disclosure. In this specification, the schematic expressions of the above terms do not necessarily refer to the same embodiment or example. Moreover, the specific features, structures, materials or characteristics described may be combined appropriately in one or more embodiments or examples.

What is claimed is:

1. A microwave oven, provided with a cooking cavity and an electrical chamber located behind the cooking cavity, a magnetron, a frequency converter assembly and a cooling fan being arranged in the electrical chamber, wherein the frequency converter assembly comprises:

a mounting support, mounted on a bottom plate of the microwave oven;

a mounting base, obliquely mounted on the mounting support;

a frequency converter circuit board, mounted on the mounting base and obliquely arranged relative to the bottom plate of the microwave oven; and an air guide cover, covering over the frequency converter circuit board and used for guiding cool air blown by the cooling fan to the frequency converter circuit board.

2. The microwave oven according to claim 1, wherein an air guide inlet opposite to an air outlet of the cooling fan is formed at the front end of the air guide cover, and an air guide outlet communicating with the air guide inlet is formed at the tail end of the air guide cover.

3. The microwave oven according to claim 2, wherein an air inlet passage is formed between an outer cover of the microwave oven and the side wall of the cooking cavity, the bottom plate of the microwave oven is provided with air inlets communicating with the air inlet passage, and an exhaust opening of the cooling fan faces the air inlet passage.

4. The microwave oven according to claim 2, wherein the air guide cover comprises two opposite side plates and a cover plate connected with the two side plates, the air guide inlet is formed at the front end of the cover plate, and the plate surface of the cover plate is gradually inclined upwards from back to front.

5. The microwave oven according to claim 4, wherein a rear plate of the microwave oven is provided with an exhaust outlet communicating with the air guide outlet.

6. The microwave oven according to claim 1, wherein the mounting support is provided with guide bevels gradually inclined downwards from front to back, and the mounting base is supported on the guide bevels.

7. The microwave oven according to claim 6, wherein barbs extending upwards are formed at the tail end of the guide bevels, the tail end of the mounting base abuts against the barbs, and a lug for limiting the mounting base to move left and right is arranged at the tail end of the mounting base.

8. The microwave oven according to claim 7, wherein a mounting groove with the upper end opened is formed in the mounting base, the frequency converter circuit board is located in the mounting groove, and the air guide cover is mounted above the mounting base and clamped with the mounting base.

9. The microwave oven according to claim 1, wherein a plurality of magnetrons, a plurality of frequency converter assemblies and a plurality of cooling fans for cooling the plurality of magnetrons and the plurality of frequency converter assemblies are arranged in the electrical chamber.

10. The microwave oven according to claim 9, wherein each of the upper part and the lower part of the electrical chamber is provided with one magnetron, each of two sides of the magnetron at the upper part is provided with one cooling fan, and each of two sides of the magnetron at the lower part is provided with one frequency converter assembly.

11. The microwave oven according to claim 2, wherein a plurality of magnetrons, a plurality of frequency converter assemblies and a plurality of cooling fans for cooling the plurality of magnetrons and the plurality of frequency converter assemblies are arranged in the electrical chamber.

12. The microwave oven according to claim 3, wherein a plurality of magnetrons, a plurality of frequency converter assemblies and a plurality of cooling fans for cooling the plurality of magnetrons and the plurality of frequency converter assemblies are arranged in the electrical chamber.

13. The microwave oven according to claim 4, wherein a plurality of magnetrons, a plurality of frequency converter assemblies and a plurality of cooling fans for cooling the plurality of magnetrons and the plurality of frequency converter assemblies are arranged in the electrical chamber.

14. The microwave oven according to claim 5, wherein a plurality of magnetrons, a plurality of frequency converter assemblies and a plurality of cooling fans for cooling the plurality of magnetrons and the plurality of frequency converter assemblies are arranged in the electrical chamber.

15. The microwave oven according to claim 6, wherein a plurality of magnetrons, a plurality of frequency converter assemblies and a plurality of cooling fans for cooling the plurality of magnetrons and the plurality of frequency converter assemblies are arranged in the electrical chamber.

16. The microwave oven according to claim 7, wherein a plurality of magnetrons, a plurality of frequency converter assemblies and a plurality of cooling fans for cooling the plurality of magnetrons and the plurality of frequency converter assemblies are arranged in the electrical chamber.

17. The microwave oven according to claim 8, wherein a plurality of magnetrons, a plurality of frequency converter assemblies and a plurality of cooling fans for cooling the plurality of magnetrons and the plurality of frequency converter assemblies are arranged in the electrical chamber.

18. The microwave oven according to claim 11, wherein each of the upper part and the lower part of the electrical chamber is provided with one magnetron, each of two sides of the magnetron at the upper part is provided with one cooling fan, and each of two sides of the magnetron at the lower part is provided with one frequency converter assembly.

19. The microwave oven according to claim 12, wherein each of the upper part and the lower part of the electrical chamber is provided with one magnetron, each of two sides of the magnetron at the upper part is provided with one cooling fan, and each of two sides of the magnetron at the lower part is provided with one frequency converter assembly.

20. The microwave oven according to claim 13, wherein each of the upper part and the lower part of the electrical chamber is provided with one magnetron, each of two sides of the magnetron at the upper part is provided with one cooling fan, and each of two sides of the magnetron at the lower part is provided with one frequency converter assembly.

* * * * *